US010252520B2

(12) United States Patent
Suzuki

(10) Patent No.: US 10,252,520 B2
(45) Date of Patent: Apr. 9, 2019

(54) DIGITAL PRINTING PRESS

(71) Applicant: Komori Corporation, Tokyo (JP)

(72) Inventor: Yasuhiro Suzuki, Yamagata (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/519,141

(22) PCT Filed: Oct. 5, 2015

(86) PCT No.: PCT/JP2015/078180
§ 371 (c)(1),
(2) Date: Apr. 13, 2017

(87) PCT Pub. No.: WO2016/059995
PCT Pub. Date: Apr. 21, 2016

(65) Prior Publication Data

US 2017/0232730 A1 Aug. 17, 2017

(30) Foreign Application Priority Data

Oct. 16, 2014 (JP) ..... 2014-211408

(51) Int. Cl.
*B41J 3/46* (2006.01)
*B41J 2/045* (2006.01)
(Continued)

(52) U.S. Cl.
CPC ..... *B41J 2/0451* (2013.01); *B41J 2/01* (2013.01); *B41J 2/04586* (2013.01);
(Continued)

(58) Field of Classification Search
CPC .. B41J 2/01; B41J 11/00; B65H 43/00; B65H 43/04; B65H 43/08
See application file for complete search history.

(56) References Cited

U.S. PATENT DOCUMENTS 5,280,322 A 1/1994 Kono
6,259,887 B1 * 7/2001 Awano ..... G03G 15/6573 399/390
(Continued)

FOREIGN PATENT DOCUMENTS

CN 1353045 A 6/2002
CN 1596377 A 3/2005
(Continued)

OTHER PUBLICATIONS

Supplementary European Search Report received for EP Patent Application No. 15850838.2, dated Jun. 13, 2018, 5 pages.
(Continued)

*Primary Examiner* — Sharon A. Polk
(74) *Attorney, Agent, or Firm* — Womble Bond Dickinson (US) LLP

(57) ABSTRACT

A digital printing press including a printing cylinder configured to transport a sheet, a driving device (41) configured to drive the printing cylinder, an encoder (44) configured to detect the phase of the printing cylinder, and first to fourth inkjet heads configured to print the sheet. The digital printing press includes a floating detector facing the printing cylinder and configured to detect an abnormality of the sheet, a display device, and a control device configured to control an operation of the driving device. The control device includes a function of stopping the driving device when the floating detector detects a floating portion. The control device includes a function of obtaining information specifiable a position of an abnormality occurrence portion based on the phase of the printing cylinder when the floating detector detects the floating portion and the phase of the printing cylinder when the driving device stops after floating detection and displaying the information on the display device. The digital printing press is capable of quickly
(Continued)

specifying an abnormality occurrence portion detected during printing.

4 Claims, 4 Drawing Sheets

(51) Int. Cl.

| | |
|---|---|
| ***B41J 2/01*** | (2006.01) |
| ***B41J 29/38*** | (2006.01) |
| ***B41J 29/42*** | (2006.01) |
| ***B65H 7/06*** | (2006.01) |
| ***B41J 11/00*** | (2006.01) |
| ***B41J 13/22*** | (2006.01) |
| ***B65H 7/14*** | (2006.01) |

(52) U.S. Cl.
CPC ..... *B41J 11/0095* (2013.01); *B41J 13/223* (2013.01); *B41J 29/38* (2013.01); *B41J 29/42* (2013.01); *B65H 7/06* (2013.01); *B65H 7/14* (2013.01); *B41J 3/46* (2013.01)

(56) References Cited

U.S. PATENT DOCUMENTS

| | | | | |
|---|---|---|---|---|
| 6,309,063 | B1 | 10/2001 | Kamano et al. | |
| 2004/0233244 | A1* | 11/2004 | Elgee | B41J 29/393 347/19 |
| 2007/0097167 | A1 | 5/2007 | Ishikawa | |
| 2011/0227985 | A1* | 9/2011 | Korogi | B41J 29/38 347/16 |

FOREIGN PATENT DOCUMENTS

| | | | | |
|---|---|---|---|---|
| DE | 69720205 | T2 | | 9/2003 |
| EP | 0897806 | B1 | | 3/2003 |
| JP | H06-083142 | A | | 3/1994 |
| JP | H10-235976 | A | | 9/1998 |
| JP | 2011-195221 | A | | 10/2011 |
| JP | 2012-166347 | A | | 9/2012 |
| JP | 2013-248879 | A | | 12/2013 |
| JP | 2014139097 | A | * | 7/2014 |
| WO | 98/26934 | A1 | | 6/1998 |

OTHER PUBLICATIONS

International Search Report and Written Opinion received for PCT Patent Application No. PCT/JP2015/078180, dated Dec. 8, 2015, 9 pages (4 pages of English Translation and 5 pages of Original Document).

International Preliminary Report on Patentability received for PCT Patent Application No. PCT/JP2015/078180, dated Apr. 27, 2017, 9 pages (5 pages of English Translation and 4 pages of Original Document).

Office Action received for Chinese Patent Application No. 201580056025.6, dated Jun. 26, 2018, 8 pages (3 pages of English Translation and 5 pages of Office Action).

* cited by examiner

DIGITAL PRINTING PRESS

TECHNICAL FIELD

The present invention relates to a digital printing press that performs digital printing on a sheet.

BACKGROUND ART

As a conventional digital printing press, there exists an inkjet type described in, for example, patent literature 1. In the digital printing press disclosed in patent literature 1, a sheet rotates together with a printing cylinder and is thus transported between an inkjet nozzle head (to be simply referred to as an inkjet head hereinafter) and the printing cylinder.

Printing is performed by ejecting ink from the inkjet head to the sheet in a state in which the sheet is located between the printing cylinder and the inkjet head. To obtain high print quality, the inkjet head is arranged at a position where a small gap is formed with respect to the sheet.

For this reason, if the sheet partially floats up from the printing cylinder, the distance between the sheet and the inkjet head changes to cause a print error. Additionally, the floating portion may contact the inkjet head, and the inkjet head may be damaged.

To prevent such an error, the conventional digital printing press includes a floating detector configured to detect a portion of a sheet floating from the printing cylinder.

The conventional digital printing press including an abnormality detector like the floating detector employs an arrangement that stops a motor for driving the printing cylinder and stops the printing cylinder upon detecting an abnormality during printing.

RELATED ART LITERATURE

Patent Literature

Patent Literature 1: Japanese Patent Application No. 2011-195221

DISCLOSURE OF INVENTION

Problem to be Solved by the Invention

Because an inertial force acts, the printing cylinder slightly rotates by inertia during the time after an abnormality is detected during printing, and the drive motor stops until the printing cylinder comes to rest. For this reason, the abnormality occurrence portion can hardly be specified, and the time needed to cope with the abnormality or track down the cause of the abnormality becomes long.

The present invention has been made to solve the above-described problem, and has as its object to provide a digital printing press capable of quickly specifying an abnormality occurrence portion detected during printing.

Means of Solution to the Problem

In order to achieve the above-described object, according to the present invention, there is provided a digital printing press comprising a printing cylinder configured to hold and transport a sheet, a driving device configured to drive the printing cylinder, a phase detector configured to output detection data specifiable a phase of the printing cylinder, an inkjet head provided at a position facing the printing cylinder and configured to print the sheet, an abnormality detector provided at a position facing the printing cylinder and configured to detect an abnormality of one of the printing cylinder and the sheet, a display device configured to display visually recognizable information, and a control device configured to control an operation of the driving device, wherein the control device includes a function of stopping the driving device when the abnormality detector detects the abnormality, and a function of obtaining information specifiable a position of an abnormality occurrence portion based on the phase of the printing cylinder when the abnormality detector detects the abnormality and the phase of the printing cylinder when the driving device stops after abnormality detection and displaying the information on the display device.

Effect of the Invention

According to the present invention, after the abnormality detector detects an abnormality, the printing cylinder stops, and information specifiable the abnormality occurrence portion is displayed on the display device. The abnormality occurrence portion can be searched for in a state in which the position of the abnormality occurrence portion is approximately estimated. It is therefore possible to easily find the abnormality occurrence portion.

Hence, according to the present invention, it is possible to provide a digital printing press capable of quickly specifying an abnormality occurrence portion detected during printing.

BEST MODE FOR CARRYING OUT THE INVENTION

Figure 1:
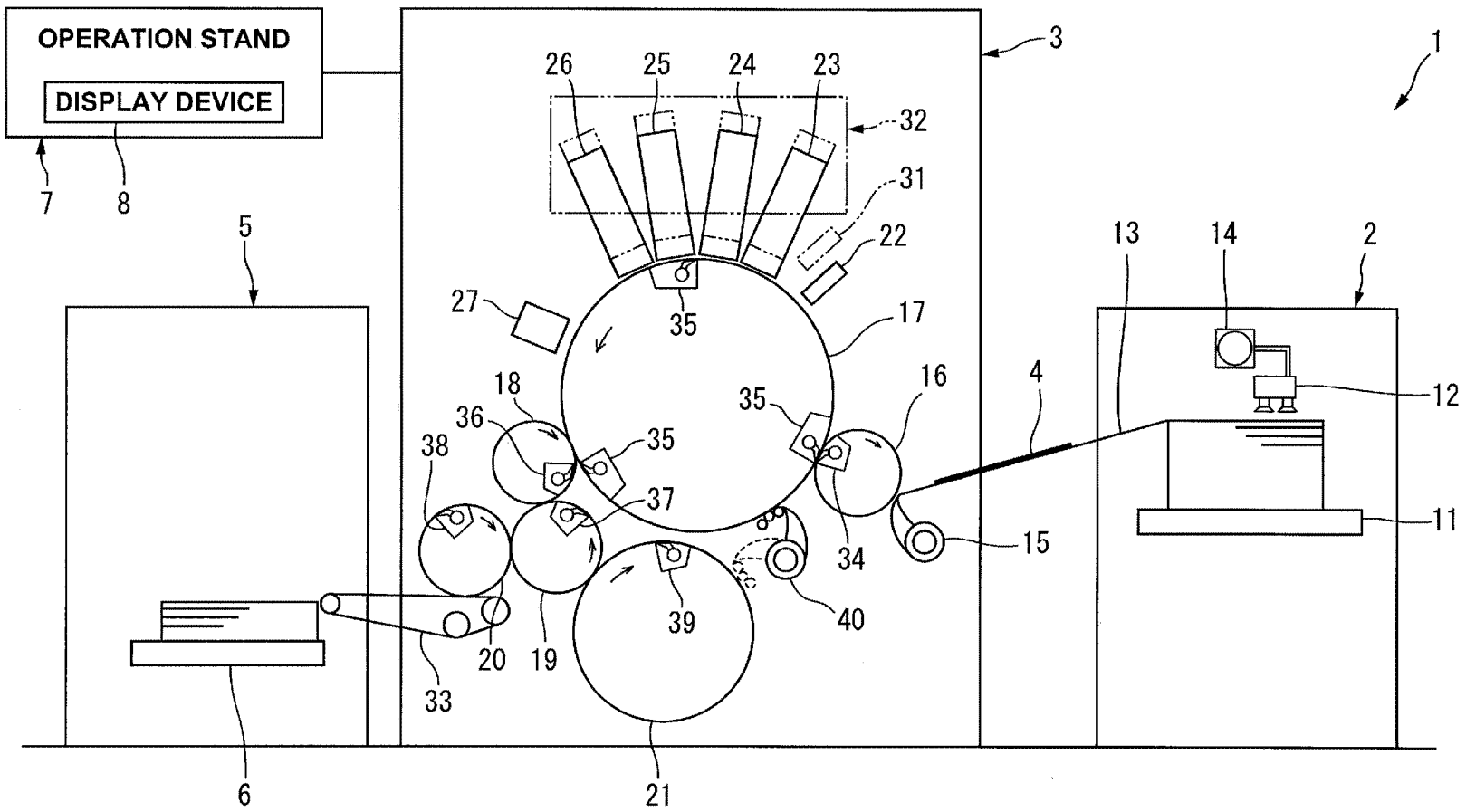
FIG. 1 is a side view showing the arrangement of a digital printing press according to the present invention.

A digital printing press according to an embodiment of the present invention will now be described in detail with reference to FIGS. 1 to 5. In a digital printing press 1 shown in FIG. 1, a sheet 4 is transported from a feeder unit 2 located at the rightmost position in FIG. 1 to a print unit 3, and the print unit 3 prints one surface or both surfaces of the sheet 4. The sheet 4 printed by the print unit 3 is fed to a delivery unit 5 and discharged to a delivery pile 6. The digital printing press 1 is operated by an operator (not shown) on an operation stand 7. The operation stand 7 is provided with a display device 8 that displays information visually recognizable by the operator.

The feeder unit 2 involves a mechanism to transfer the sheet 4 from a feeder pile 11 to a feeder board 13 by a sucker 12. The sucker 12 is connected to an intermittent feeder valve 14, and operates in one of a mode to continuously feed the sheet 4 and a mode to intermittently feed the sheet 4. To print only the obverse surface of the sheet 4, the sucker 12 continuously feeds the sheet 4 to the feeder board 13. On the other hand, to print the obverse surface and the reverse surface of the sheet 4, the sucker 12 intermittently feeds the sheet 4 to the feeder board 13.

The print unit 3 includes a feeder-side transfer cylinder 16 to which the sheet 4 supplied from the feeder unit 2 is transported by a feeder-side swing device 15, a printing cylinder 17 to which the sheet 4 is fed from the feeder-side transfer cylinder 16, and a plurality of transport cylinders 18 to 21 to which the sheet 4 after printing is fed. Although details are not illustrated, the printing cylinder 17 involves a mechanism to suck and hold the sheet 4. The print unit 3 also includes a floating detector 22 located on the downstream side of the feeder-side transfer cylinder 16 in the transportation direction, first to fourth inkjet nozzle heads 23 to 26 located on the downstream side of the floating detector 22 in the transportation direction, and an ink drying lamp 27 located on the downstream side of the fourth inkjet nozzle head 26 in the transportation direction.

The floating detector 22 detects a portion of the sheet 4 sucked and transported by the printing cylinder 17, the portion which is separated from the surface of the printing cylinder 17. The portion of the sheet 4 separated from the surface of the printing cylinder 17 will simply be referred to as a "floating portion" hereinafter. The floating detector 22 can be formed from a noncontact detector including a photoelectric sensor, a contact detector including a contactor (not shown) that comes into contact with the sheet 4, or the like.

Figure 2:
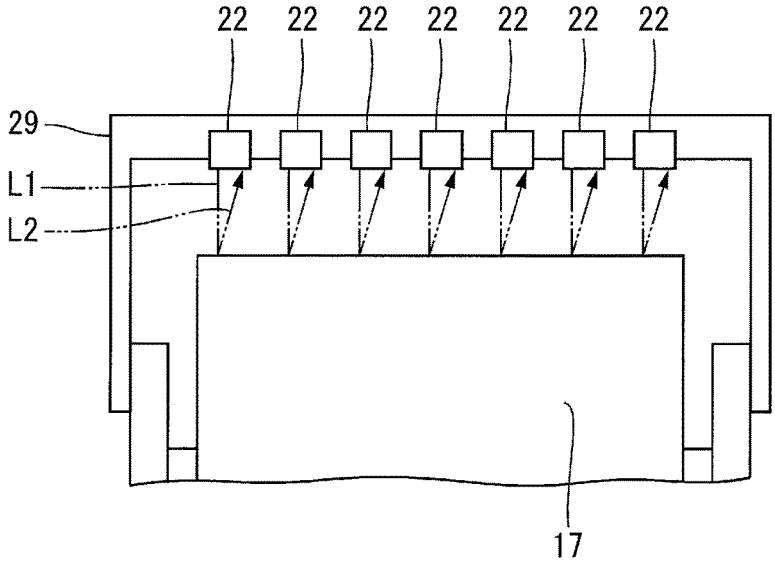
FIG. 2 is a front view for explaining the arrangement of a floating detector.

The floating detector 22 according to this embodiment detects a floating portion of the sheet 4 and sends the detection result as detection data to a control device 28 (see FIG. 4) to be described later. If the floating detector 22 is formed from a noncontact detector, a plurality of floating detectors 22 are arranged at positions facing the outer surface of the printing cylinder 17, as shown in FIG. 2. The floating detectors 22 each irradiate the printing cylinder 17 (sheet 4) with irradiation light L1, and detect light L2 reflected by the sheet 4, thereby measuring the interval between the surface of the sheet 4 and the floating detector 22.

The floating detectors 22 are arranged at a predetermined interval in the axial direction (the horizontal direction in FIG. 2) of the printing cylinder 17 and, in this state, supported by a frame 30 via a bracket 29. The frame 30 rotatably supports the printing cylinder 17 and the transport cylinders 18 to 21. In this embodiment, the floating detector 22 corresponds to "abnormality detector" of the present invention. Note that if a heater (not shown) configured to heat the sheet 4 is provided, the abnormality detector of the present invention can be formed by a temperature detector 31 (see FIG. 1). The sheet 4 is heated to improve print quality. In the digital printing press including the heater, the temperature detector 31 is provide at a position facing the printing cylinder 17 to measure the surface temperature of the sheet 4 or the surface temperature of the printing cylinder 17.

The first to fourth inkjet nozzle heads 23 to 26 each eject ink and make it adhere to the sheet 4.

The first to fourth inkjet nozzle heads 23 to 26 according to this embodiment are supported by a head moving device 32. The head moving device 32 moves the first to fourth inkjet nozzle heads 23 to 26 between a print position close to the printing cylinder 17 and a separate position separated from the printing cylinder 17. As the head moving device 32, for example, the same device as described in Japanese Patent Laid-Open No. 2013-248879 can be used.

In FIG. 1, the first to fourth inkjet nozzle heads 23 to 26 located at the print position are indicated by solid lines. When moving to the separate position, the first to fourth inkjet nozzle heads 23 to 26 move to positions indicated by alternate long and two short dashed lines.

The operation of the head moving device 32 is controlled by the control device 28 (to be described later).

The ink drying lamp 27 cures the ink applied to the sheet 4 by the first to fourth inkjet nozzle heads 23 to 26.

The plurality of transport cylinders described above include the first discharge-side transfer cylinder 18 that receives the sheet 4 from the printing cylinder 17, the second discharge-side transfer cylinder 19 that receives the sheet 4 from the first discharge-side transfer cylinder 18, and the delivery cylinder 20 and the pre-reversal double-size cylinder 21 both of which receive the sheet 4 from the second discharge-side transfer cylinder 19. The sheet 4 whose reverse surface should be printed is transported from the second discharge-side transfer cylinder 19 to the pre-reversal double-size cylinder 21. The sheet 4 whose obverse surface should only be printed or the sheet 4 with the obverse and reverse surfaces printed is fed from the second discharge-side transfer cylinder 19 to the delivery cylinder 20 and fed to the delivery pile 6 via a delivery belt 33.

The feeder-side transfer cylinder 16, the printing cylinder 17, the first discharge-side transfer cylinder 18, the second discharge-side transfer cylinder 19, the delivery cylinder 20, and the pre-reversal double-size cylinder 21 include gripper devices 34 to 39, respectively, to transfer the sheet 4. The gripper devices 34 to 39 each have a conventionally known structure to grip and hold the leading edge of the sheet 4 in the feeding direction. The gripper device 35 of the printing cylinder 17 is provided at each of positions dividing the outer surface of the printing cylinder 17 into three equal parts.

A reversing swing device 40 configured to feed the sheet 4 from the pre-reversal double-size cylinder 21 to the printing cylinder 17 is arranged between the pre-reversal double-size cylinder 21 and the feeder-side transfer cylinder 16. The reversing swing device 40 grips the trailing edge of the sheet 4 in the feeding direction, which is fed by the pre-reversal double-size cylinder 21, and feeds the sheet 4 to the printing cylinder 17 in a state in which the obverse surface faces the printing cylinder 17.

Figure 4:
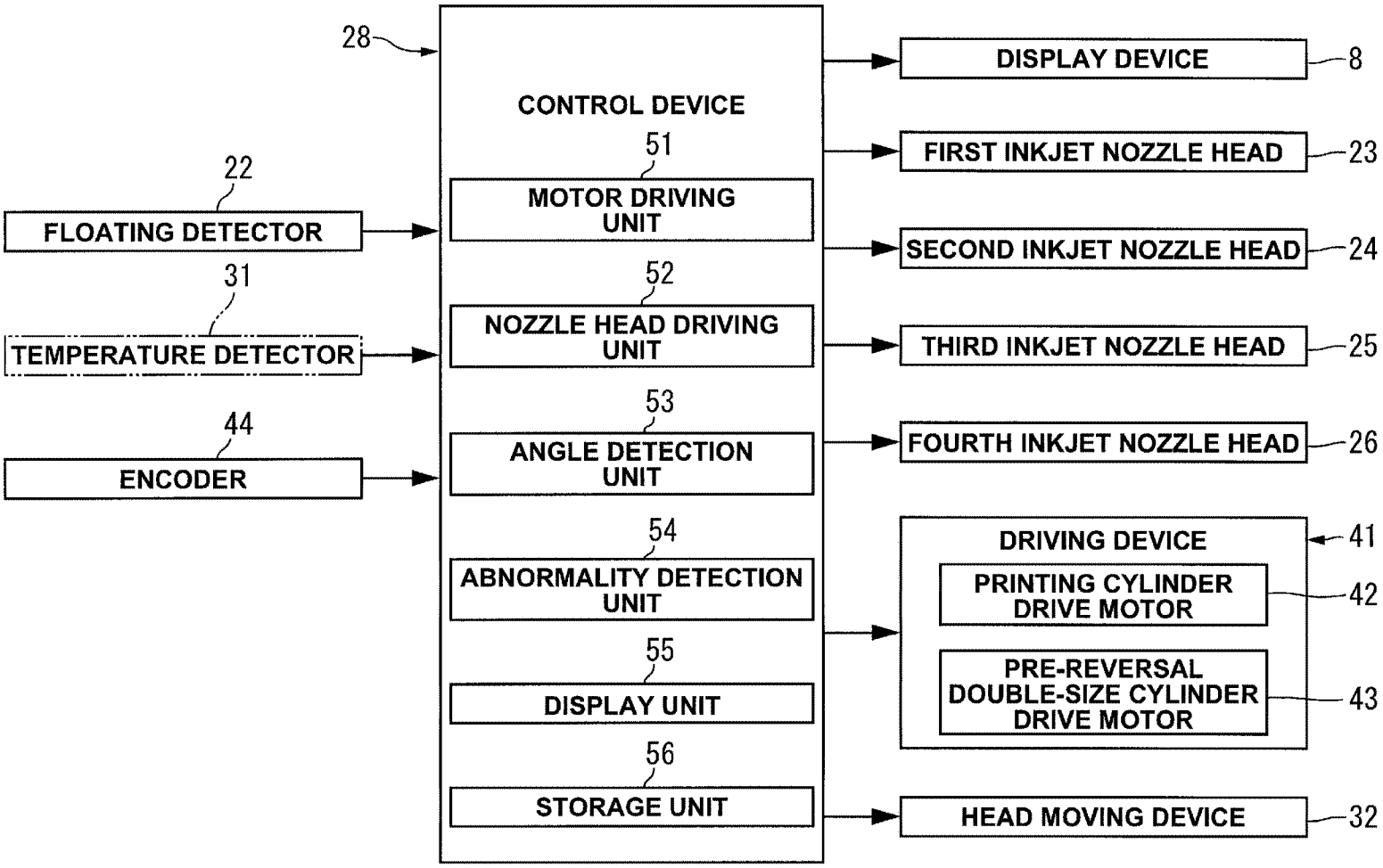
FIG. 4 is a block diagram showing the arrangement of the control device of the digital printing press according to the present invention.

The plurality of cylinders 16 to 21 and the two swing devices 15 and 40 included in the print unit 3 are driven by a driving device 41 (see FIG. 4). The driving device 41 includes a printing cylinder drive motor 42 configured to drive the plurality of transport cylinders 16 to 21, including the printing cylinder 17, and a pre-reversal double-size cylinder drive motor 43 configured to drive only the pre-reversal double-size cylinder 21. The operation of the driving device 41 is controlled by the control device 28. The driving device 41 also includes an encoder 44 that detects the angle of rotation of the printing cylinder drive motor 42. The encoder 44 sends the angle of rotation of the printing cylinder drive motor 42 as detection data to the control device 28. In this embodiment, the encoder 44 corresponds to "phase detector" of the present invention.

The control device 28 is configured to control the operation of the digital printing press 1, and includes a motor driving unit 51, a nozzle head driving unit 52, an angle detection unit 53, an abnormality detection unit 54, a display unit 55, and a storage unit 56.

When the digital printing press 1 performs printing, the motor driving unit 51 operates the driving device 41 to obtain a predetermined print speed. If the abnormality detection unit 54 (to be described later) detects an abnormality, the motor driving unit 51 stops the driving device 41.

When the digital printing press 1 performs printing, the nozzle head driving unit 52 operates the first to fourth inkjet nozzle heads 23 to 26 and also operates the ink drying lamp 27. If the abnormality detection unit 54 (to be described later) detects an abnormality, the nozzle head driving unit 52 operates the head moving device 32 to move the first to fourth inkjet nozzle heads 23 to 26 to the separate position.

The angle detection unit 53 detects the angle of rotation of the printing cylinder 17 based on output data of the encoder 44. That is, the output data of the encoder 44 is data specifiable the phase of the printing cylinder 17.

The abnormality detection unit 54 detects, as an abnormality, a case in which the height (floating amount) of a floating portion of the sheet 4 detected by the floating detector 22 is more than a predetermined determination value. The abnormality detection unit 54 according to this embodiment stores the angle of rotation of the printing cylinder 17 upon detecting an abnormality in the storage unit 56. The angle of rotation of the printing cylinder 17 is a value detected by the angle detection unit 53.

Figure 3:
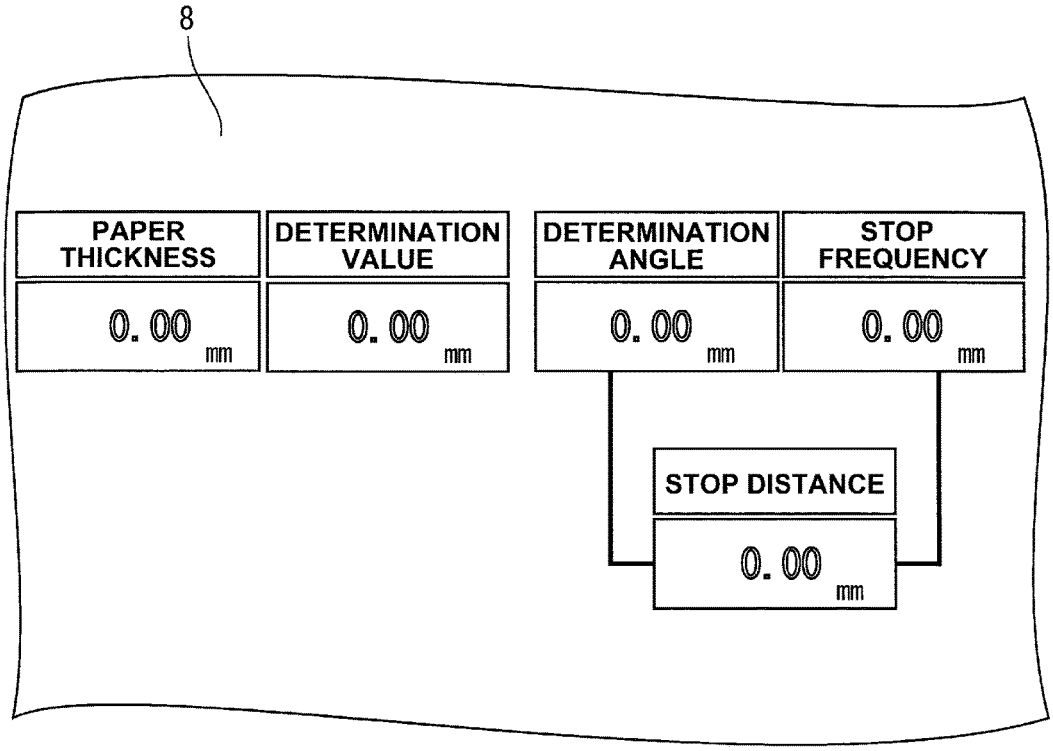
FIG. 3 is a front view showing part of a display device.

The display unit 55 displays data representing the operation state of the digital printing press 1 on the display device 8. The display device 8 displays a paper thickness, a determination value, a determination angle, a stop frequency, a stop distance, and the like, as shown in FIG. 3.

The paper thickness is the thickness of the sheet 4. The determination value is the thickness of the sheet 4 discriminated as a floating portion by the abnormality detection unit 54. The determination angle, the stop frequency, and the stop distance are numerical values obtained by executing control at the time of abnormality detection (to be described later). The control procedure at the time of abnormality detection will be described here with reference to the flowchart of FIG. 5.

Figure 5:
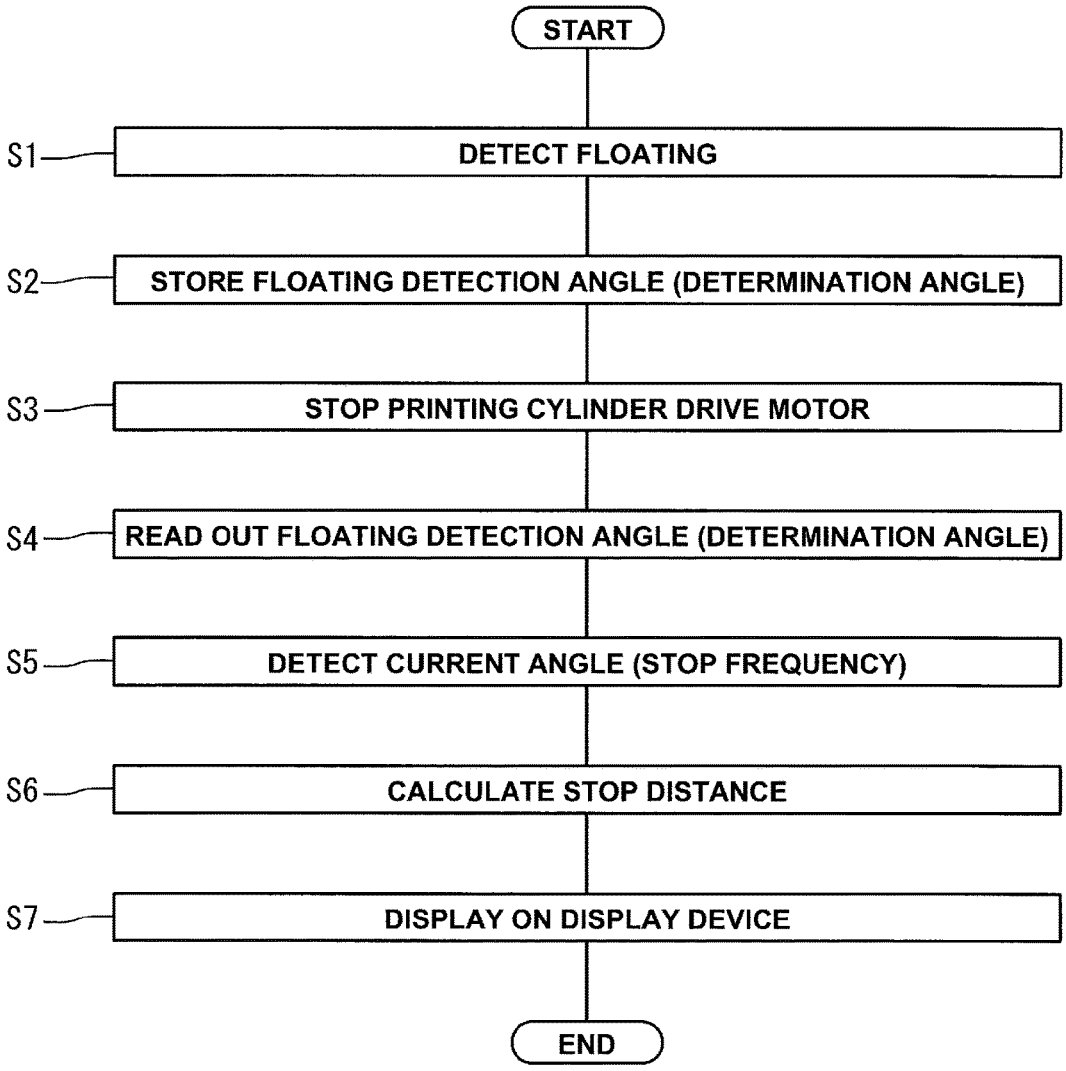
FIG. 5 is a flowchart for explaining a control procedure at the time of abnormality detection.

Control at the time of abnormality detection is started by detecting a floating portion of the sheet 4 by the floating detector 22 in step S1 of the flowchart shown in FIG. 5. Note that for the sake of convenience, a description will be made here assuming a state in which the floating detector 22 detects a floating portion whose height is detected by the abnormality detection unit 54 of the control device 28 as an abnormality.

If the floating detector 22 detects the floating portion of the sheet 4, in step S2, the control device 28 stores the angle of rotation (phase) of the printing cylinder 17 at the time of floating detection as a determination angle. Note that in FIG. 5, the angle of rotation of the printing cylinder 17 at the time of floating detection is simply described as "floating detection angle".

In step S3, the control device 28 stops power supply to the printing cylinder drive motor 42 and the pre-reversal double-size cylinder drive motor 43 of the driving device 41 and stops the driving device 41. That is, the control device 28 includes a function of stopping the driving device 41 when the floating detector 22 (abnormality detector) detects a floating portion (abnormality).

The printing cylinder drive motor 42 of the driving device 41 rotates the printing cylinder 17 and the plurality of transport cylinders 16 to 20 at a high speed during printing. Hence, because an inertial force acts, each of the printing cylinder 17 and the plurality of transport cylinders 16 to 20 rotates by inertia by a predetermined angle after the stop of power supply to the driving device 41, and then stops and comes to rest.

After the driving device 41 is stopped, as described above, the control device 28 reads out the determination angle that is the angle of rotation of the printing cylinder 17 from the storage unit 56 in step S4, and detects the stop frequency that is the current angle of rotation (phase) of the printing cylinder 17 at rest in step S5. Note that in FIG. 5, the current angle of rotation of the printing cylinder 17 is simply described as "current angle". Then, in step S6, based on the angle of rotation of the printing cylinder 17 at the time of floating detection and the angle of rotation after the stop, the control device 28 calculates the stop distance that is the distance of the rotation of the printing cylinder 17 by inertia from the floating detection to the rest. The stop distance is information specifiable the position of the floating portion because it corresponds to the distance between the position at which the floating detector 22 detects the floating portion and the current position of the floating portion after the stop of the printing cylinder 17.

After that, in step S7, the control device 28 displays the determination angle, the stop frequency, and the stop distance described above on the display device 8. That is, the control device 28 includes a function of obtaining the pieces of information (the stop frequency and the stop distance) specifiable the position of the floating portion (abnormality occurrence portion) based on the angle of rotation (phase) of the printing cylinder 17 when the floating detector 22 detects the floating portion and the angle of rotation (phase) of the printing cylinder 17 when the driving device 41 stops after floating detection and displaying these pieces of information on the display device 8.

For this reason, if the control at the time of abnormality detection is executed, the printing cylinder 17 stops after the floating detector 22 detects the floating portion of the sheet 4, and the pieces of information (the stop frequency and the stop distance of the printing cylinder 17) specifiable the position of the floating portion are displayed on the display device 8. Since the floating portion can be searched for in a state in which the position of the floating portion is approximately estimated, it is possible to easily find the abnormality occurrence portion.

Hence, according to the present invention, it is possible to provide a digital printing press capable of quickly specifying an abnormality occurrence portion detected during printing.

The display device 8 according to this embodiment displays the distance between the detection position at which the floating detector 22 detects the floating portion and the abnormality occurrence portion after the stop of the printing cylinder 17. For this reason, according to this embodiment, even if the printing cylinder 17 stops after the rotation by inertia, the abnormality occurrence portion can be specified by a numerical value. Hence, the abnormality occurrence portion can be specified more easily.

The abnormality detector according to this embodiment is formed from the floating detector 22 that detects a portion of the sheet 4 transported by the printing cylinder 17, the portion which is separated from the surface of the printing cylinder 17.

For this reason, according to this embodiment, it is possible to quickly specify an abnormality occurrence portion where the interval between the sheet 4 and the first to fourth inkjet nozzle heads 23 to 26 is narrower than a predetermined interval. Hence, according to this embodiment, it is possible to provide a digital printing press in which no print error is caused by contact between the sheet 4 and the first to fourth inkjet nozzle heads 23 to 26, and the first to fourth inkjet nozzle heads 23 to 26 are not damaged by the contact with the sheet 4.

The digital printing press 1 according to this embodiment includes the head moving device 32 that moves the first to fourth inkjet nozzle heads 23 to 26 between the print position close to the printing cylinder 17 and the separate position separated from the printing cylinder 17. The head moving device 32 is configured to move the first to fourth inkjet nozzle heads 23 to 26 from the print position to the separate position when the floating detector 22 detects an abnormality.

It is therefore possible to prevent the floating portion of the sheet 4 from coming into contact with the first to fourth inkjet nozzle heads 23 to 26 and damaging the first to fourth inkjet nozzle heads 23 to 26 during the time after power supply to the printing cylinder drive motor 42 is stopped until the printing cylinder 17 comes to rest. In addition, the first to fourth inkjet nozzle heads 23 to 26 separate from the sheet 4 or the printing cylinder 17, and the sheet 4 or the printing cylinder 17 can be easily visually recognized. Hence, the floating portion of the sheet 4 can be specified more quickly.

The display device 8 according to this embodiment is provided on the operation stand 7. Hence, the operator can quickly confirm the abnormal portion. In addition, as compared to a case in which a display device configured to display only an abnormality occurrence portion is arranged near, for example, the print unit 3, information other than the abnormality occurrence portion can be displayed on the display device 8, and the display device 8 can be shared by a plurality of functional units. For this reason, the manufacturing cost of the digital printing press can be reduced.

The display device 8 can be provided in a place other than the operation stand 7. That is, the display device 8 can be provided near the abnormality detector or in the shaft end of the printing cylinder 17. The display device 8 provided on the shaft end of the printing cylinder 17 can be formed by light-emitting members arranged at a predetermined interval on the outer surface of the printing cylinder 17 in the circumferential direction. When this arrangement is employed, a light-emitting member located closest to the abnormality occurrence portion is caused to emit light in a state in which the printing cylinder 17 is at rest after abnormality detection.

EXPLANATION OF THE REFERENCE NUMERALS AND SIGNS

1 . . . digital printing press, 4 . . . sheet, 8 . . . display device, 17 . . . printing cylinder, 22 . . . floating detector, 23 . . . first inkjet nozzle head, 24 . . . second inkjet nozzle head, 25 . . . third inkjet nozzle head, 26 . . . fourth inkjet nozzle head, 28 . . . control device, 41 . . . driving device, 44 . . . encoder (phase detector).

The invention claimed is:

1. A digital printing press comprising:

a printing cylinder configured to hold and transport a sheet;

a driving device configured to drive the printing cylinder;

a phase detector configured to output detection data specifiable a phase of the printing cylinder;

an inkjet head provided at a position facing the printing cylinder and configured to print the sheet;

an abnormality detector provided at a position facing the printing cylinder and configured to detect an abnormality of one of the printing cylinder and the sheet;

a display device configured to display visually recognizable information, wherein the display device is configured to display a distance between a detection position at which the abnormality detector detects the abnormality and the abnormality occurrence portion after the printing cylinder stopped; and a control device configured to control an operation of the driving device, wherein the control device has a function of stopping the driving device when the abnormality detector detects the abnormality, and a function of obtaining information with which a position of an abnormality occurrence portion is specified based on the phase of the printing cylinder when the abnormality detector detects the abnormality and the phase of the printing cylinder when the driving device stops after abnormality detection and display the information on the display device.

2. The digital printing press according to claim 1, wherein the abnormality detector detects a portion of the sheet transported by the printing cylinder, the portion which is separated from a surface of the printing cylinder.

3. The digital printing press according to claim 2, further comprising a moving device configured to move the inkjet head between a print position close to the printing cylinder and a separate position separated from the printing cylinder, wherein the head moving device moves the inkjet head from the print position to the separate position when the abnormality detector detects the abnormality.

4. The digital printing press according to claim 1, further comprising a head moving device configured to move the inkjet head between a print position close to the printing cylinder and a separate position separated from the printing cylinder, wherein the head moving device moves the inkjet head from the print position to the separate position when the abnormality detector detects the abnormality.

* * * * *